US005626255A

United States Patent [19]

Myers

[11] Patent Number: 5,626,255

[45] Date of Patent: May 6, 1997

[54] VIDEO CASSETTE CASE STYLE DRINK CONTAINER

[75] Inventor: William H. Myers, Laguna Niguel, Calif.

[73] Assignee: Strottman International, Inc., Irvine, Calif.

[21] Appl. No.: 352,860

[22] Filed: Dec. 2, 1994

[51] Int. Cl.[6] ..... B65D 6/00

[52] U.S. Cl. ..... 220/411; 220/705; D9/326

[58] Field of Search ..... 220/411, 402, 220/705, 339; D9/417, 326

[56] References Cited

U.S. PATENT DOCUMENTS

| | | | |
|---|---|---|---|
| D. 100,772 | 8/1936 | Guyer | D9/326 |
| D. 281,056 | 10/1985 | De La Tour | D9/326 X |
| D. 287,069 | 12/1986 | Egley et al. | D9/326 X |
| D. 296,664 | 7/1988 | Hjalmarsson . | |
| D. 315,870 | 4/1991 | Perdue, Jr. et al. . | |
| D. 318,427 | 7/1991 | Sherburne, Jr. | 220/705 X |
| D. 320,941 | 10/1991 | Lyon . | |
| D. 328,388 | 8/1992 | Weisburn, et al. . | |
| D. 331,685 | 12/1992 | Hetherington et al. . | |
| D. 340,642 | 10/1993 | Detzel et al. . | |
| 718,081 | 1/1903 | Brackett | D9/326 X |
| 2,341,600 | 2/1944 | Daniel | D9/326 X |
| 4,538,731 | 9/1985 | Cillario | 220/339 X |
| 5,038,932 | 8/1991 | Sheu . | |
| 5,052,614 | 10/1991 | Xuan . | |
| 5,069,385 | 12/1991 | Farber . | |
| 5,137,150 | 8/1992 | Wolf . | |
| 5,150,811 | 9/1992 | Kelston | 220/411 |

FOREIGN PATENT DOCUMENTS

| | | |
|---|---|---|
| 2452440 | 10/1980 | France . |
| 3402096A1 | 1/1985 | Germany . |
| 978901 | 1/1965 | United Kingdom . |
| 2079726 A | 1/1982 | United Kingdom . |

*Primary Examiner*—Steven M. Pollard
*Attorney, Agent, or Firm*—Richard C. Litman

[57] ABSTRACT

A drink container in the form of a hexahedronal carton shaped to simulate a video cassette storage case or box, with a pivoting top closure and a straw receiving hole formed through the pivoting top closure. A living hinge connects the top to the container, the top and container being of monolithic, one-piece construction. The case includes three recessed sides having a groove formed in these sides to further simulate a cassette storage box, the groove having the appearance of separating the box into two halves. The container may be decoratively imprinted with designs, logos, etc. on three sides to complete the video storage case simulation.

5 Claims, 3 Drawing Sheets

VIDEO CASSETTE CASE STYLE DRINK CONTAINER

BACKGROUND OF THE INVENTION

1. Field of the Invention

The present invention generally relates to drink containers, and more particularly to a drink container in the form of a video cassette box.

2. Description of the Prior Art

Drink containers, particularly soft drinks dispensed from soda fountains commonly found in eateries, especially the popular "fast food" restaurants, are, in the main, rather plain and even unappealing in style and configuration. Most are in the form of inverted, frusto-conical containers and have a lid, commonly cross-scored for insertion of a drinking straw. In recent years, however, box containers containing soft drinks and fruit ades and drinks have become increasingly popular, especially among youngsters. Such box containers often are decorated with eye catching advertising logos and other decorative material. These products are now easy to manufacture and distribute. Often, the container includes a straw, usually secured to a side of the package by shrink wrap material.

What is not seen in the art and is not available is a box shaped container in the configuration of a video cassette storage case or box, simulating the type of container used by rental outlets for storage of the video cassette, and distinct from the usual open cardboard sleeve used in the sale of video cassettes. The instant invention is a container with an integral flip-top lid secured by a living hinge arrangement, the top when open having sufficient dimensions so as to be filled easily from a standard soda or drink dispenser, the top further being provided with an opening for a drinking straw. The present invention may be used as a container for point-of-purchase retailing, or as a sealed, pre-filled container for regular, retail merchandising in grocery stores, supermarkets, convenience stores, and the like. The invention may be decorated with printed indicia which may include advertising for a preselected, popular film available on video cassette. The invention may be made in various sizes, proportions being retained from size to size, for various, predetermined internal volumes (e.g., 10 oz., 12 oz., 16 oz., etc.).

The following prior art disclosures are of interest as being generally relevant to the instant invention. A number of drink containers are known as well as a number of video cassette cases or boxes, but the combination of both into a single drink container simulating a video cassette rental storage box or case is not seen in the prior art.

Somewhat relevant video cassette cases, boxes or sleeves are disclosed in the following prior patents. A tape open sided storage carton is taught in UK patent Application No. 2 079 726 published Jan. 27, 1982, Warren R. Shepherd, inventor. The completely open long vertical side of the container makes it unsuitable for the storage of liquids. In U.S. Pat. No. 5,038,932 issued Aug. 13, 1991 to Shwan Sheu, a tape holder is seen having a pivoted end closure and a slide base to facilitate storage and removal of a tape cassette. The open construction of the invention would make entirely unsuitable as a liquid container. A video cassette storage sleeve with an entirely open, unclosed top is taught in U.S. Pat. No. D 328,388, issued Aug. 4, 1992 to James T. Weisburn. The invention is unsuitable for storing or containing liquids. U.S. Pat. No. 5,137,150 issued Aug. 11, 1992 to Hans J. Wolf teaches another hinged cover video cassette container which would be unsuitable for containing liquids.

Several prior art drink container boxes are of interest, but none are seen that simulate a video cassette box or case. For example, drink boxes having gabled end closures are taught in U.S. Pat. Nos. 5,069,385 issued Dec. 3, 1991 to Jurgen Farber, and D 340,642 issued Oct. 26, 1993 to Josef Detzel. A similar disclosure is seen in German Patent Application 3 402 096 A1 published Jan. 8, 1985, Unilever N. V., applicant. The gabled upper end corner configuration of these containers renders them unsuitable for the construction and function of the instant invention. Other patents teach drink box containers with straw holes in the tops and straws packaged with the containers. Exemplary such drink boxes are taught in U.S. Pat. No. Design 296,664 issued Jul. 12, 1988 to per H. Hjalmarsson and U.S. Pat. No. 5,052,614 issued Oct. 1, 1991 to Jialuo Xuan. A similar disclosure is found in French patent Application No. 2 452 440 published Oct. 24, 1980, Hagman Bertil, inventor. However, an enlarged but closeable top for filling and reuse filling and a box simulating a video cassette rental storage case are not seen in these patents.

A reusable drink box with a straw insertion opening is taught in U.S. Pat. No. 331,685, issued Dec. 15, 1992 to Sue A. Hetherington et al., and a drink box with a curved, upper, built in straw-like appendage is seen in UK Patent Specification 978,901 published Jan. 1, 1965, Leslie E. J. Baynes, inventor. A beverage container holder with an openable lid is disclosed in U.S. Pat. No. Design 320,941, issued Oct. 22, 1991 to Chris J. Lyon. Finally, a generally square box with a hinged lid is seen in U.S. Pat. No. Design 315,870 issued Apr. 2, 1991 to Thomas E. perdue, et al. These additional containers and boxes also fail to disclose the unique drink box of the present invention.

In summary, none of the above inventions and patents, taken either singly or in combination, is seen to describe the instant invention as claimed.

SUMMARY OF THE INVENTION

Accordingly, it is a principal object of the invention to provide a drink box container in the form of a video cassette rental case.

It is another object of the invention to provide a video cassette case style drink container with a top closure connected by a living hinge and openable to expose virtually the entire top for filling or refilling.

It is a further object of the invention to provide a video cassette case style drink container with a top lid having a straw insertion opening formed therethrough.

Still another object of the invention is to provide a video cassette case style drink container with a recloseable top lid and a thumb tab for opening the top, parts being frictionally interfit together to keep the lid closed.

It is an object of the invention to provide improved elements and arrangements thereof in an apparatus for the purposes described which is inexpensive, dependable and fully effective in accomplishing its intended purposes.

Still yet another object of the invention is to provide a video cassette case style drink container imprinted with attractive external indicia referring to a movie on cassette or the like and three recessed sides with a center groove formed therewithin, further to simulate a video cassette rental box case or container.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENT

The present invention relates to drink containers and more particularly to a drink container having the appearance of a video cassette rental storage case or box; such containers are used by rental outlets for safely storing video cassettes rented out to customers for viewing. Such cassette containers are hexahedronal in configuration, and when closed, have the general appearance of a closed, hard cover book. These containers are opened at the middle, the vertical back or spine of the container being hinged, thus to access the video cassette stored therewithin. Such containers are notoriously old and thus form no part of the instant invention per se.

Figure 1:
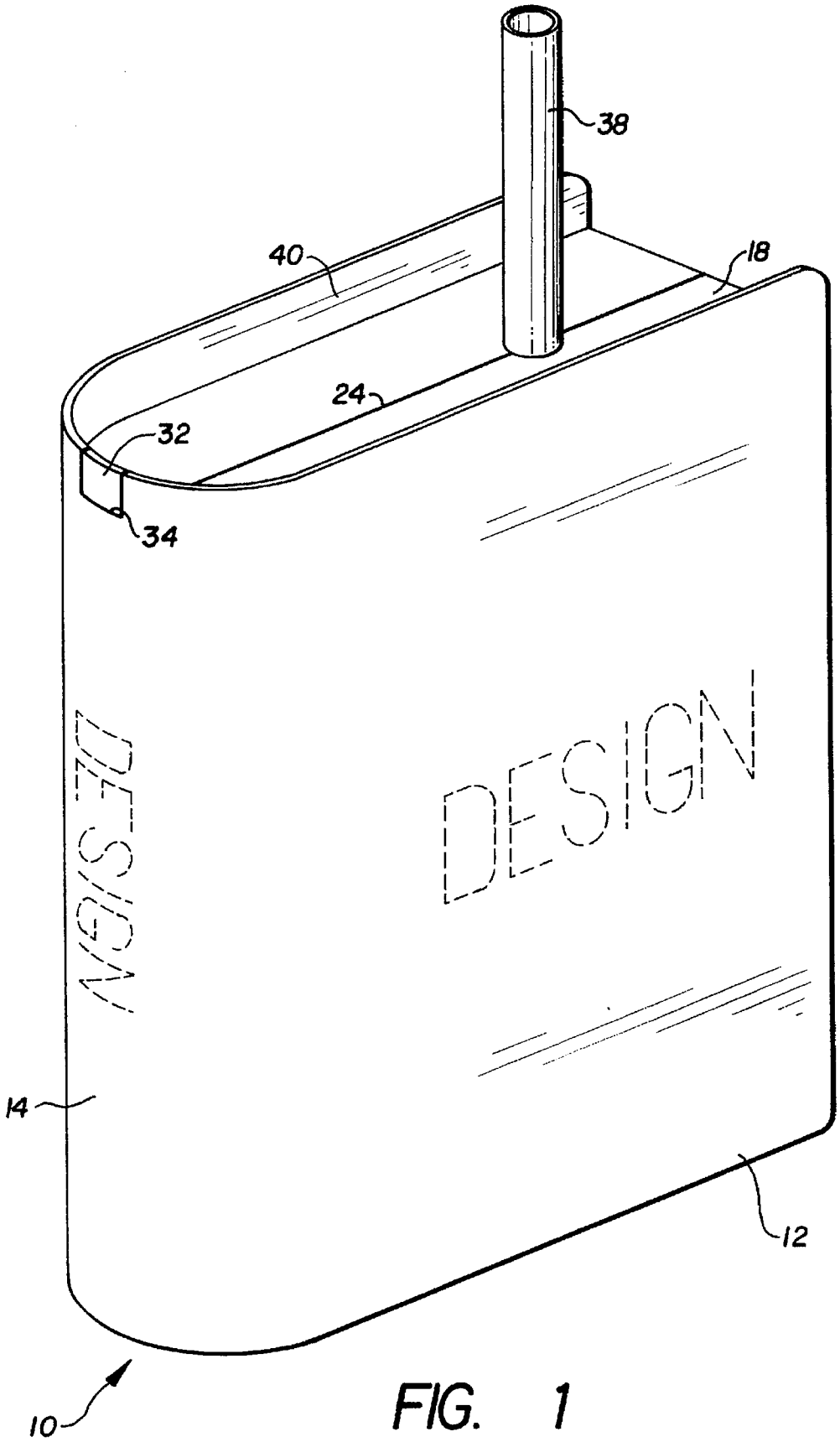
FIG. 1 is a perspective view of the rear of the invention with a straw inserted through a straw receiving opining in the top of the invention.

With reference to FIG. 1, the instant invention is a drink box or container 10 in the form of such a video cassette rental case or container. The drink box 10 is a hexahedronal container, and is generally closed hardback book shaped in external configuration, as is readily apparent from the several views. Thus, the box 10 includes a front side 12, a rear spine 14, and a rear side 16 (see FIG. 4). The sides and spine are imprinted with decorative indicia, such as the title and design jacket advertising of a popular movie so that the box 10 simulates a video cassette rental box or container.

Figure 5:
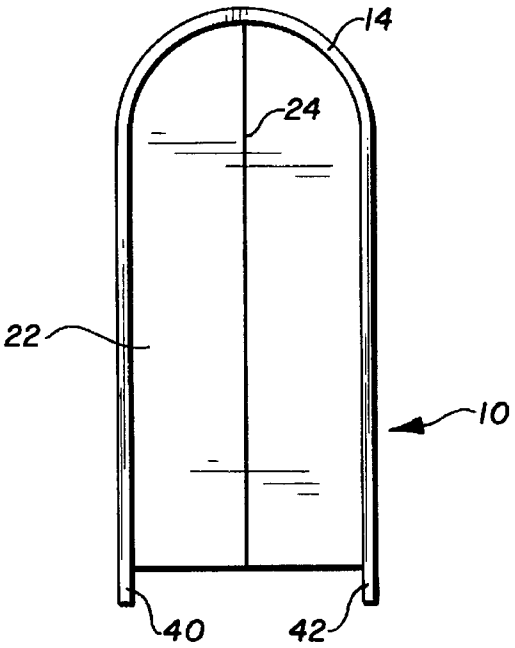
FIG. 5 is a bottom view of the invention as seen in FIG. 3, but with the top lid closed.

These elements are closed by a hinged top lid 18, a front wall 20, and a bottom wall 22 (see FIG. 5). These latter elements also include a groove or center score line 24 so that the drink container even further simulates the two openable halves of a video cassette rental box; of course, the present invention is a drink container and is not opened along line 24.

Figure 2:
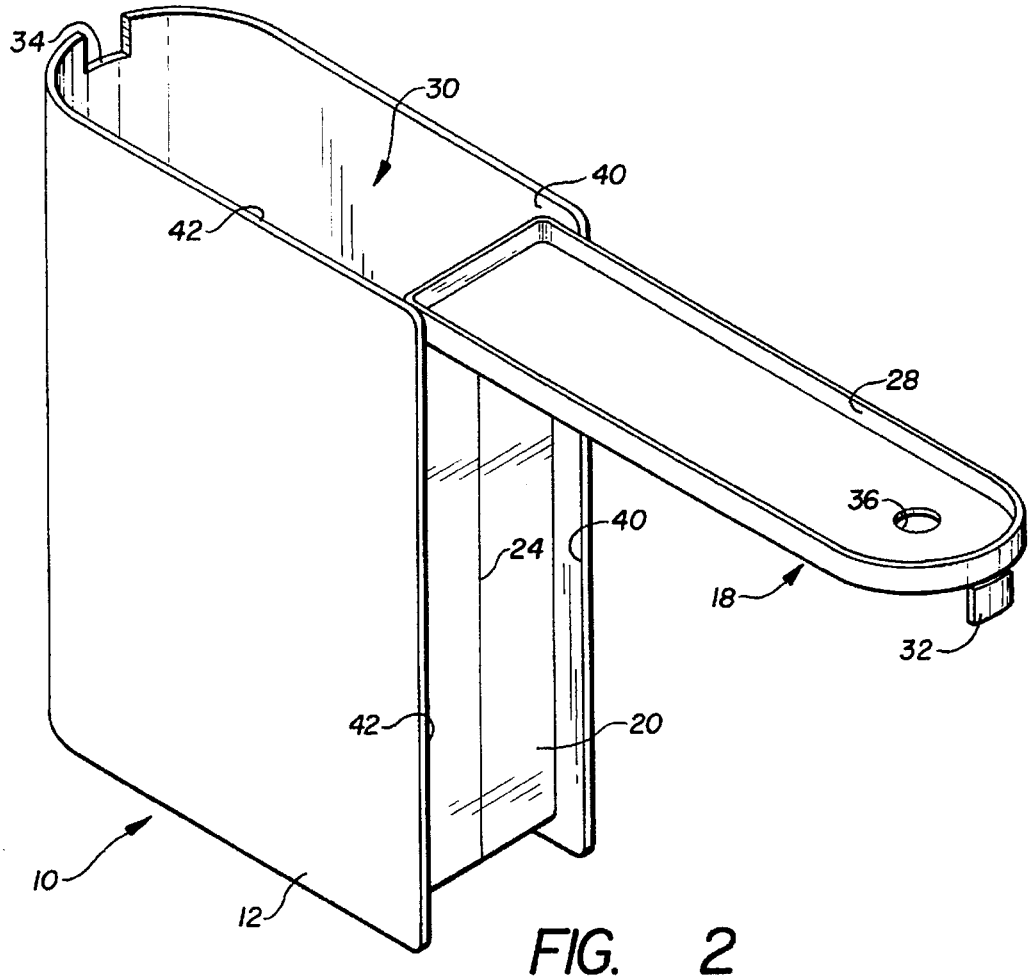
FIG. 2 is a perspective view similar to FIG. 1 but showing the front side of the invention, an a top lid opened so that the container may be filled with liquid.
Figure 3:
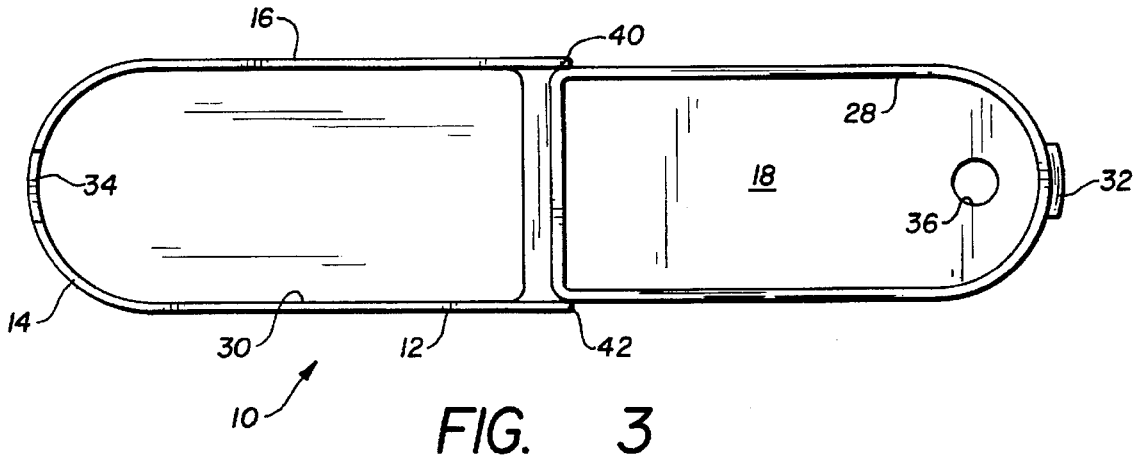
FIG. 3 is a top view of the invention as seen in FIG. 2.
Figure 4:
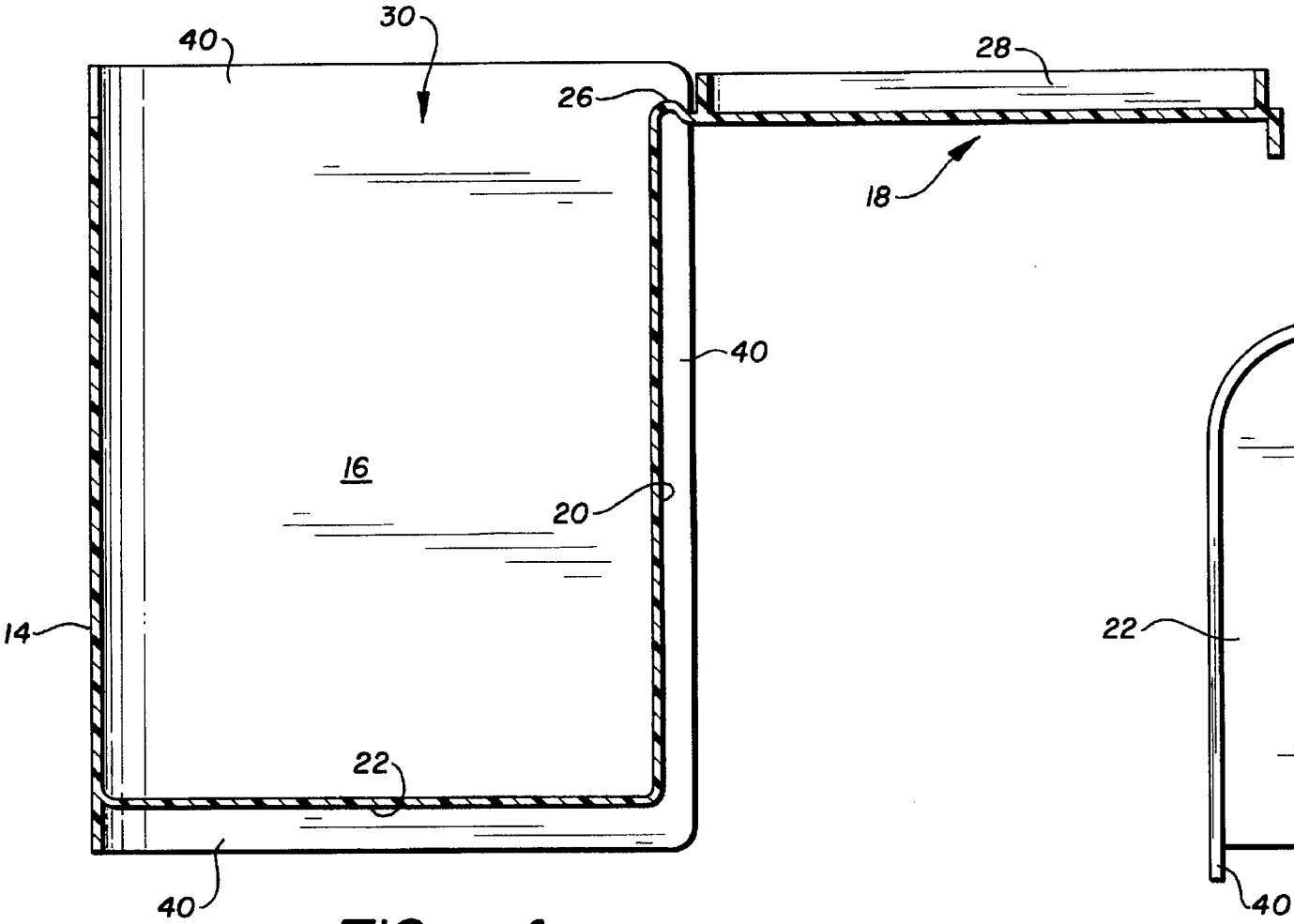
FIG. 4 is an elevational, cross sectional view of the invention as depicted in FIG. 2.

With particular reference to FIGS. 2, 3 and 4, the openable and, if desired, reclosed lid (thus making the invention reusable) is of one piece construction with the rest of the container 10, and is opened and closed about a living hinge 26. Top or lid may include an internal, peripheral lip or flange 28 which is dimensioned and configured to interfit with the extensive opening 30 in the top of box 10. This arrangement assists in assuring a rather liquid tight enclosure when the top 18 is closed. To assist in the secure closing of the top as well as opening the same for reuse, a thumb tab 32 is formed on lid 18, distal from living hinge 26. A mating tab recess 34 is formed within the upper edge of the spine 14, for friction fit interengagement with the tab 32.

Further, the top may include an opening 36 for insertion of a drinking straw 38 therethrough (see FIG. 1). If desired, the straw opening may be completely open, or of cross hatch construction whereby a straw is forced therethrough, a construction well known in the art and not illustrated. Alternatively, the opening 36 may be closed by a peel off strip (not shown) which, when removed, allows a drinking straw to be readily inserted through the now exposed opening 36. The structure thus disclosed and discussed also includes peripheral flanges 40, at the rear of the container, and 42, at the front of the container, to complete the simulative nature of the drink box as aforesaid.

In one embodiment of the invention, and by way of example only, the box 10 has an internal volume of 12 US fluid oz., approximately. Thus, a container 10 having an overall width of 3¾, a height of 4¾ inches and a through depth of 1⅞ inches is satisfactory. It should be noted here that this specific container will be much smaller than a conventional video cassette rental storage box, yet it will be of approximately similar proportions. The internal liquid container formed as best seen in FIG. 4 will be about 3¼ inches by 4¼ inches and about 1¾ inches deep, the wall dimension of all the components making up the container having a nominal thickness of about ⅛ inch, and being a bit thinner in the vicinity of living hinge 26. This allows a top opening 30 of 1¾ inches by about 3 inches, large enough to be filled from conventional drink dispensing fountains, and/or by conventional container filling machinery when the container is packaged for prefilled, retail merchandising. The material selected for fabricating the container may be selected from a wide range of well known plastics. However, at least the sides 12, 16 and the spine 14 should be capable of receiving and retaining 4 color process printing, whether by thermoimaging, hot transfer decal, or any selected electroprinting process. A reusable container would also be dishwasher safe. As for other sizes of containers according to the present invention, such may be made proportionally larger or smaller, depending on predetermined internal volume.

Furthermore, it should be noted that the box container of this invention could be insulated; a double wall configuration filled with suitable insulation material or evacuated partially or fully would provide a suitable degree of insulation for the box contents.

It is to be understood that the present invention is not limited to the sole embodiment described above, but encompasses any and all embodiments within the scope of the following claims.

I claim:

1. A drink box comprising:

a generally box-shaped, liquid impermeable, container having a bottom wall, a front wall, a rear wall, and two side walls, said container having an open top; and a lid pivotally mounted in said top, said lid forming a substantially liquid tight seal with said container, said lid including means defining an opening therethrough dimensioned and configured to provide for insertion of a drinking straw; wherein said rear wall and said side walls extend beyond said lid, said front wall and said bottom wall to form a peripheral flange, whereby said drink box has an appearance simulating a video cassette storage box.

2. The drink box according to claim 1, further comprising a living hinge connecting said lid to said container.

3. The drink box according to claim 1, wherein said lid further includes a peripheral sealing flange formed therearound.

4. The drink box according to claim 2, wherein said lid further includes a thumb tab located distally from said living hinge, and a mating thumb tab recess is formed in a wall of said box at the top thereof.

5. The drink box according to claim 1, wherein said lid, said front wall, and said bottom wall include a central groove depression therein to further simulate closed halves of a video cassette storage box.

* * * * *